US006491771B1

(12) United States Patent
von Hagen et al.

(10) Patent No.: US 6,491,771 B1
(45) Date of Patent: Dec. 10, 2002

(54) METHOD OF PRODUCING ROUND BILLETS

(75) Inventors: Ingo von Hagen, Krefeld (DE); Harald Wehage, Ilsenburg (DE); Uwe Quitmann, Willich (DE); Walter Weischedel, Moerbusch (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/868,807

(22) PCT Filed: Dec. 7, 1999

(86) PCT No.: PCT/DE99/03959

§ 371 (c)(1),
(2), (4) Date: Aug. 3, 2001

(87) PCT Pub. No.: WO00/37200

PCT Pub. Date: Jun. 29, 2000

(30) Foreign Application Priority Data

Dec. 22, 1998 (DE) ..... 198 60 570

(51) Int. Cl.[7] ..... C21D 8/00; B22D 11/00

(52) U.S. Cl. ..... 148/541; 148/546; 164/476

(58) Field of Search ..... 148/541, 546; 164/476

(56) References Cited

U.S. PATENT DOCUMENTS 5,832,985 A * 11/1998 Pleschiutschnigg et al. 148/541

* cited by examiner

*Primary Examiner*—Deborah Yee
(74) *Attorney, Agent, or Firm*—Cohen, Pontani, Lieberman & Pavane

(57) ABSTRACT

A process and device for the production of continuously cast billets in a production plant employs a vertical, round strand-casting machine with horizontal run-out, at least one descaling device, and several following roll stands. For the production of round billets with diameters in the range of 90–300 mm, after the solidifying round billet has left the mold but before it has entered the following rolling unit, its surface is descaled and the area near the surface is cooled in defined manner to a temperature which is optimum for the grade of steel in question before the round billet is worked, first over the course of at least three successive horizontal passes then in a vertical pass, the surface of the preworked billet being descaled again before the last pass.

8 Claims, 1 Drawing Sheet

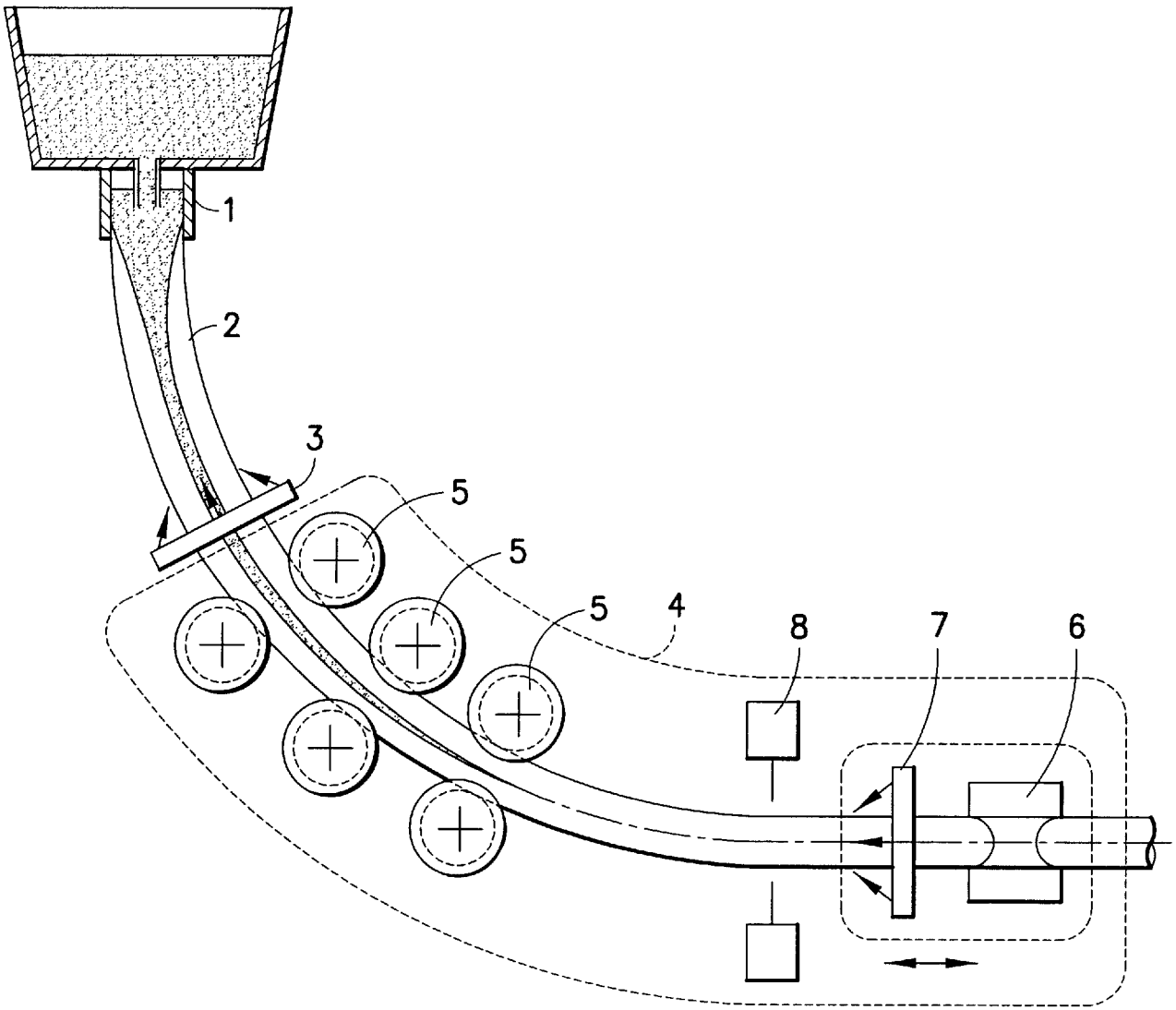
1
2
3
4
5
5
5
6
7
8

METHOD OF PRODUCING ROUND BILLETS

PRIORITY CLAIM

This is a U.S. national stage of application No. PCT/DE99/03959, filed on Dec. 7, 1999. Priority is claimed on that application and on the following application:

Country: Germany, Application No.: 198 60 570.6, Filed: Dec. 22, 1998.

BACKGROUND OF THE INVENTION

1. Field of the Invention

The invention pertains to a process for the production of continuous-cast billets in a production plant consisting of a vertical, round strand-casting machine with horizontal run-out, at least one descaling device, and several following roll stands.

2. Description of the Related Art

After they have solidified, the billets produced in a vertical, round strand-casting machine with horizontal run-out may show differences in the material concentrations over their cross section. For example, porous areas occur in almost all steels just underneath the surface and in the core. Especially affected by this phenomenon are the free-cutting steels. Carbon-manganese steels have segregations in the core area, which impede the production of high-strength wire, for example. In the case of high-carbon chromium steels, "hairs" form in the core, which impair the quality of the inside surface of high-precision rolled tubular products. Depending on their chemical composition, austenitic stainless chromium-nickel steels can contain a large amount of δ-ferrite in some cases as a second phase, which, in the case of round billets, has a pronounced maximum at a distance from the core equal to 0.4–0.7 × the radius; this phase significantly impairs the deformability of these steels during the following cross-rolling process, because the main deformation zone is in this cross-sectional area. As a result, only limited degrees of elongation can be realized. General problems with deformability in the form of tears and peeling start to occur as soon as the average δ-ferrite content exceeds 4%.

There are various causes of these material inhomogeneities. By way of example, the following can be cited here: material data, material impurities, molten metal temperature, casting flux, mold design, solidification rate, and casting speed.

To improve the surface quality of metal strands, it is known that slag, scale, and similar foreign materials can be vacuumed from the surface of the strand as soon as the strand has been cast, i.e., as close as possible to withdrawal from the mold, before the strand is contacted by the spray water (DE 4,123,956 C2).

Various measures for reducing or preventing the material inhomogeneities described above are known. One possibility is to reduce the casting speed as a way of increasing the cooling rate in the mold and secondary cooling areas. This idea suffers from the disadvantage that the distributor of the continuous casting machine could freeze up, and it also has the effect of decreasing production.

Another possibility is electromagnetic stirring (EMS) of the solidifying molten metal in the strand, which offers the advantages that the solidifying crystallites are broken, the molten metal is well stirred, and the resulting fine equiaxed grain solidification structure is obtained over a large internal area of the strand cross section. The disadvantage is that the area near the surface is mostly excluded from these positive effects unless the stirring is carried out at high intensity. Another disadvantage is that the EMS unit is stationary. Thus a second stirrer is required in the lower part of the continuous casting machine to stir the core area. Overly intense stirring can also lead to an expansion of the core as a result of the effects of centrifugal force.

Another proposal, which is used in the continuous casting of square or rectangular billets, is to replace the withdrawal driver with so-called stationary gripper stands in the curved part of the strand, in which stands the billet is deformed alternately between smooth horizontal and vertical pairs of rolls while the core is still liquid. The vertical pairs of rolls must squeeze back into place the material which has spread or bulged out during the horizontal passes. The degree to which forming is possible, that is, the degree of height reduction, is limited, because the position of the tip of the liquid crater varies with different grades of steel, with the billet cross sections, and with the casting and solidification rates. In the case of steels which are susceptible to cracking, the deformation of the edge and corner areas of the billet cross section is especially critical. For these reasons, this approach can be applied only to certain grades of steel.

Finally, another possibility used in practice is to forge large square or rectangular billets both in the height and width directions while the core is still liquid. The advantage is that forging can compress the strand over a greater length than rolling can, as a result of which the core area can be densified to a greater degree. The disadvantage is the obvious limitation of the process to large cross sections, because it is impossible to position a forging machine in the curved part of the cast strand.

Common to all the embodiments of the state of the art described above is that the possibilities of controlling the differences in material concentrations over the cross section of the billet, especially in the case of a vertical, round strand-casting machine with horizontal run-out, are limited.

SUMMARY OF THE INVENTION

Proceeding from the problems and disadvantages of the state of the art, the task of the present invention is to find a process and a device for the production of round billets with diameters in the range of 90–300 mm, which process and device make it possible, when used appropriately, to break down the disadvantageous material inhomogeneities over the cross section and to lower their absolute content.

To accomplish this task, it is proposed in accordance with the invention that, after the solidifying round billet has emerged from the mold but before it has entered the following rolling unit, the surface of the billet be descaled and the area near the surface be precooled in a defined manner to a temperature which is optimum for the steel in question, this being done before the round billet is worked over the course of at least three successive horizontal passes and one vertical pass, the surface of the preformed billet being descaled again before the last pass.

The measures according to the invention achieve the goal that the concentration differences over the cross section in the form of, for example, segregations and second phases, are broken down and their content sharply reduced as a result of the in-line preworking of the outer ring layer, this being accompanied by the densification of the core both while it is still liquid and after it has solidified. Depending on the grade of steel, the core area of the round billet can be almost completely densified. The material density is increased by the elimination of pores both below the surface and in the core.

According to an elaborative feature of the invention, it is provided that, as the round billet is worked in the horizontal passes, it be subjected to increasing degrees of height deformation of $\phi$=0.10–0.15 as the diameter of the molten metal core decreases progressively with the course of solidification, and that, after the round billet has solidified completely, the vertical pass be performed in the horizontal run-out area of the production plant at a point whose position relative to the location of the horizontal working is adjustable in the axial direction of the strand.

As a result of the increasing degree of working to which the billet is subjected in the horizontal passes as the diameter of the molten metal core decreases and the working in the subsequent vertical pass, the location of which can be moved to the area of the strand where the core has completely solidified, which varies as a function of the material to be rolled and the dimensions of the round billet, a preworked material structure in an outer ring layer with a thickness of equal to of half the radius and with a nearly completely densified core area is obtained for downline deformation processes.

For this purpose, according to another feature of the invention, it is provided that the casting speed and/or the location of the point where the vertical pass is performed are controlled in such a way that the tip of the liquid crater of the solidifying round billet is situated in the area between the third horizontal pass and the vertical pass and that complete solidification all the way to the core is guaranteed no later than the point at which the vertical pass is performed.

A device for implementing the process according to the invention is characterized in that, between the vertical round strand-casting machine and its horizontal run-out, a primary descaling system and a multi-stand rolling unit with at least three successive horizontal stands are installed still in the curved part of the guide stand, and in that the horizontal stands are followed in the horizontal part of the strand guide by a vertical stand with a flange-mounted secondary descaling device, which stand can be moved back and forth in the direction of strand travel relative to the position of the tip of the liquid crater.

The round billets are first descaled in the area of the tip of the liquid crater at the end of the curved section of the cast strand; the area near the skin layer is precooled in a defined manner to a temperature optimum for the steel in question. Then the billet is deformed first over the course of at least three successive horizontal passes and then by a final vertical pass, the surface of the preworked billet being descaled again before the last pass. As a result of deformation in the horizontal and vertical directions, the desired preworked material structure with a nearly completely densified core area favorable for the downline deformation processes is obtained.

The number of horizontal stands depends on the diameter of the round billet, on the casting speed, and on the degree to which the amount of height reduction in the horizontal passes can be increased. The solidification of the core area is completed by the choice of the distance between the last stationary horizontal stand and the movable vertical stand. As a result, the round form of the billet can be restored by only a single vertical pass with a high degree of reduction.

According to a supplemental feature of the invention, the last of the horizontal stands can be designed so that it can be screwed down under load. As a result, in cooperation with a downline measuring device for measuring the height and width of the preworked billet, a system of automatic roll gap control can be implemented, which ensures that the correct preliminary section is delivered to the following vertical round pass. The adjustment should be done in such a way that the deformation is distributed with the greatest possible uniformity around the circumference of the billet and that the tensile stresses in the surface are minimized. The compressive stress on the center of the billet should be increased over the course of the successive passes, during which the widthwise expansion of the billet should be prevented, and the roundness and dimensional accuracy of the billet after leaving the rolling unit should be guaranteed.

According to the invention, the nozzles of the primary descaling device arranged in a ring around the round billet are supplied with water or a water-air mixture. The distance between the nozzles and the surface of the round billet and the pressure and intensity of the medium striking the surface of the round billet can be adjusted to their optimum values.

The secondary descaling device, consisting of at least one ring of nozzles, is flange-mounted on the vertical stand and can be shifted along with it. The nozzles, distributed around the circumference of the billet which has been preworked in the horizontal stands, are supplied with compressed air. The distance between the nozzles and the surface of the preworked billet and the distance from ring to ring and of the nozzles from each other around the circumference of the ring will also be optimized.

As a result of the measures according to the invention, especially the preworking and densification of the continuously cast strand, the pores are closed, the cross-sectional area of the shrinkage cavities are reduced by about 15–35% versus the case without preworking, and concentration differences in the form of segregations, phase separations, and second phases are broken down and their absolute content reduced. As a result of the preworking, furthermore, the quality of the surface of the round billets is improved, and the danger of slipping during subsequent cross-rolling is reduced. Because the predeformed material structure has a higher deformation capacity than the original continuously cast structure, a greater degree of elongation can be achieved in the course of subsequent working processes.

An exemplary embodiment of the production plant according to the invention for the production of preworked, continuously cast round strands is described below.

BRIEF DESCRIPTION OF THE DRAWINGS

1 designates the vertical, round strand-casting machine with horizontal run-out, in the mold of which a round billet with a diameter in the range of 90–300 mm is cast and then withdrawn from below. In the curved stand of the plant, the round billet 2 is deflected from the vertical to the horizontal direction and treated in the manner according to the invention. For this purpose, the round billet, which is still liquid on the inside, is first descaled in a primary descaling device 3 and simultaneously cooled to create the surface conditions for the following roll deformation of the round billet. This deformation occurs in a multi-stand rolling unit 4 consisting of three successive horizontal roll stands 5, each with false-round grooving consisting of two radii with a continuous transition between them. The last of the three horizontal roll stands can be screwed down under load and is provided with a roll gap control system, which cooperates with the measuring device 8 for the height and width of the round billet. It can be seen that the tip of the liquid crater ends just behind the last horizontal roll stand 5 of the rolling unit 4. In the area where the round billet 2 is known to have solidified with certainty all the way through, a final rolling of the round billet 2 occurs in the vertical stand 6, after a secondary descaling at 7. This vertical stand 6 can be shifted in the direction of the arrow in order to adjust the deformation point in relationship to the tip of the liquid crater of the round billet 2 in such a way that the deformation always occurs in the solidified region of the round billet 2. The position of the tip of the liquid crater can vary depending on the casting speed, the material, and the dimensions of the round billet 2. In this case, the vertical stand 6 can be moved in the casting direction or in the opposite direction; the casting speed can be adjusted appropriately; or possibly the vertical stand 6 can be shifted and the casting speed adjusted in combination.

What is claimed is:

1. A process for producing continuously cast steel billets in a production plant which includes a vertical, round strand-casting machine with a horizontal run-out, at least one descaling device, and a following multi-stand rolling unit having horizontal roll stands and at least one vertical roll stand, said process comprising:

after a round billet cast in a mold of said casting and having a diameter in the range of 90–300 mm has left the mold but before said billet enters the following rolling unit and while said billet is solidifying, subjecting said billet to a descaling and a cooling of an area thereof proximal a surface of said billet in a defined manner to a temperature optimum for the billet steel before working the billet; and working the billet over a course of at least three successive horizontal passes and then in one vertical pass, the billet being subjected to another descaling after the horizontal passes but before the vertical pass.

2. A process according to claim 1, wherein the billet is worked in the horizontal passes at increasing degrees of deformation in a height direction of $\phi$=0.01–0.15 as a diameter of a liquid core of said billet decreases progressively with a course of billet solidification, and wherein after the billet has solidified completely in a production plant horizontal run-out area, the vertical pass is practiced at a point whose location in a strand axial direction is adjustable relative to a location site at which billet horizontal deformation is practiced.

3. A process according to claim 2, wherein one of a casting speed and the point at which the vertical pass is practiced are controlled such that a tip of a liquid crater of the solidifying billet is situated in an area between a third horizontal pass location and the point at which the vertical pass is practiced, and further such that the core is completely solidified at a time that the billet reaches location of the vertical pass point.

4. A device for production of continuously cast steel billets in a production plant comprising:

a vertical, round strand casting machine for casting a steel billet , said machine having a horizontal run-out section;

a primary descaling device;

a multi-stage rolling unit, said primary descaling system being disposed between said casting machine and said horizontal run-out section, said rolling unit including at least three successive horizontal roll stands arranged in a curved part of a guide stand, said rolling unit further including a following vertical roll stand arranged downstream of the horizontal roll stands in a horizontal part of a strand guide; and a flange-mounted secondary descaling device, said vertical roll stand being moveable back and forth in a strand travel direction relative to a position of a tip of a liquid crater in said billet.

5. A device according to claim 4, wherein rolls of said horizontal roll stands include false-round grooving comprising two radii with a continuous transition between said two radii, a last of the in-line horizontal roll stands including a roll gap system operative under a load, a roll of said vertical roll stand having open round grooving.

6. A device according to claim 4, wherein said primary descaling device includes nozzles arranged in a ring around the billet for directing a medium of at least one of water and a water—air mixture onto said billet, a distance between said nozzles and a surface of said billet, and a pressure and intensity of said medium striking said billet surface being adjustable to optimum values.

7. A device according to claim 4, wherein the secondary descaling device includes at least one ring of nozzles to which compressed air can be supplied, said secondary descaling device being flange mounted to said vertical roll stand for movement with said vertical roll stand, said secondary descaling device nozzles being distributed around a circumference of said billet preworked in the horizontal roll stands, a distance between said secondary descaling device nozzles and a surface of said preworked billet, and a distance between the nozzle rings of said primary and secondary descaling devices, and a circumferential distance of one nozzle from an adjacent nozzle in each of said rings being adjustable to optimum values.

8. A device according to claim 7, wherein a last of the in-line horizontal roll stands is configured so that the roll stand can be screwed down under a load.

* * * * *